US008072125B2

(12) United States Patent
Torii et al.

(10) Patent No.: US 8,072,125 B2
(45) Date of Patent: Dec. 6, 2011

(54) SPARK PLUG FOR USE IN AN INTERNAL-COMBUSTION ENGINE WITH A BILAYER GROUND ELECTRODE

(75) Inventors: Kazuyoshi Torii, Aichi (JP); Kazumasa Yoshida, Nagoya (JP); Wataru Matsutani, Nagoya (JP)

(73) Assignee: NGK Spark Plug Co., Ltd. (JP)

( * ) Notice: Subject to any disclaimer, the term of this patent is extended or adjusted under 35 U.S.C. 154(b) by 411 days.

(21) Appl. No.: 11/687,828

(22) Filed: Mar. 19, 2007

(65) Prior Publication Data

US 2007/0216275 A1 Sep. 20, 2007

(30) Foreign Application Priority Data

Mar. 20, 2006 (JP) ..... JP2006-075806
Mar. 2, 2007 (JP) ..... JP2007-052234

(51) Int. Cl.
*H01T 13/32* (2006.01)
*H01T 13/39* (2006.01)

(52) U.S. Cl. ..... 313/142; 313/11.5; 313/311

(58) Field of Classification Search ..... 313/11.5, 313/118, 141, 142, 311
See application file for complete search history.

(56) References Cited

U.S. PATENT DOCUMENTS 4,331,899 A * 5/1982 Nishida et al. ..... 313/141
5,210,457 A * 5/1993 Oshima et al. ..... 313/11.5
5,578,894 A * 11/1996 Oshima ..... 313/141
5,675,209 A * 10/1997 Hall et al. ..... 313/141
6,326,719 B1 * 12/2001 Boehler et al. ..... 313/141
2001/0025617 A1 * 10/2001 Kanao ..... 123/169 EL
2002/0070646 A1 * 6/2002 Chiu ..... 313/141

(Continued)

FOREIGN PATENT DOCUMENTS

EP 0725463 A1 8/1996

(Continued)

OTHER PUBLICATIONS

Takafumi et al., Spark Plug for Internal Combustion Engine, Machine translation of JP-05-013146.*

(Continued)

*Primary Examiner* — Nimeshkumar Patel
*Assistant Examiner* — Steven Horikoshi
(74) *Attorney, Agent, or Firm* — Kusner & Jaffe

(57) ABSTRACT

A spark plug 100 comprised of a metal shell 1, an insulator 2, a center electrode 3 and a ground electrode 4. A rear-end face of the ground electrode 4 is welded to a front-end face of the metal shell 1, and a bent portion 5 located at the intermediated position in the longitudinal direction is bent toward the center of the spark plug 100. The ground electrode 4 assumes a circular-shape with a diameter of 2 mm or less whereby an inflow of an air-fuel mixture is not disturbed even when the air-fuel mixture directly flows into a back face of the ground electrode 4. The ground electrode 4 is comprised of an outer layer 4A made of a nickel alloy and an inner layer 4B made of pure copper with an excellent thermal conductivity, in which a ratio of a cross-sectional area of the inner layer 4B to the entire cross-sectional area of the ground electrode 4 is 10% or more to 35% or less. Thus, the spark plug 100 which is excellent in heat sinking ability and can prevent a spring back phenomenon due to a difference in a coefficient of thermal expansion.

8 Claims, 7 Drawing Sheets

U.S. PATENT DOCUMENTS

| | | | | |
|---|---|---|---|---|
| 2002/0130602 | A1* | 9/2002 | Kanao et al. | 313/141 |
| 2003/0038575 | A1* | 2/2003 | Hori et al. | 313/141 |
| 2004/0041505 | A1* | 3/2004 | Fischer et al. | 313/141 |

FOREIGN PATENT DOCUMENTS

| | | |
|---|---|---|
| JP | 5-13146 | 1/1993 |
| JP | 05-013146 | 1/1993 |
| JP | 11-121142 | 4/1999 |

OTHER PUBLICATIONS

Office Action from corresponding Chinese Patent Application No. 2007-10088227.6, issued on Jun. 17, 2010 (with English translation); 22 pages.

* cited by examiner

SPARK PLUG FOR USE IN AN INTERNAL-COMBUSTION ENGINE WITH A BILAYER GROUND ELECTRODE

FIELD OF THE INVENTION

The present invention relates to a spark plug for use in an internal-combustion engine.

BACKGROUND OF THE INVENTION

A spark plug for use in internal-combustion engines, such as the engine of an automobile includes, for example, a center electrode, an insulator provided outside thereof, a cylindrical metal shell disposed outside of said insulator and a ground electrode whose rear portion is joined to a front-end face of said metal shell. The ground electrode assumes a generally rectangular form in the cross-section and is disposed so that a front-end portion inner side face thereof faces the front-end face of the center electrode. Thus, a spark discharge gap is formed between the front-end portion of the center electrode and the front-end portion of the ground electrode.

A screw portion (not illustrated) is formed on an outer circumferential face of the metal shell. A spark plug is mounted on an engine in such a manner that the screw portion of the metal shell screws into a female thread of a plug opening formed in the engine cylinder head. When the spark plug is mounted such that an air-fuel mixture is exposed to a back face of the ground electrode, there is a possibility that the inflow of the air-fuel mixture to the spark discharge gap may be disturbed by the ground electrode. As a result, the ignitability of the spark plug is unlikely to be stable.

On the other hand, the conventional art discloses a spark plug having two or more ground electrodes therein in which each ground electrode assumes a columnar form with a generally circular-shape in the cross-section (e.g. Japanese Patent Application Laid-Open (kokai) No. H11-121142). Thus, with forming the ground electrode into the generally circular-shape in the cross-section, the air-fuel mixture is unlikely to be exfoliated from the ground electrode and easily reaches the spark discharge gap by flowing to the inner side of the ground electrode, even in a case where the air-fuel mixture is exposed to the back face of the ground electrode.

However, since a ground electrode is joined to a front-end face of a metal shell, the cross-sectional area of the circular-shaped ground electrode has to be smaller than that of the rectangular-shaped ground electrode. As a result, so-called heat sinking ability (heat dispersion) of the ground electrode deteriorates, and the temperature thereof tends to increase at the time of high speed driving or the like. Consequently, the ground electrode suffers considerable erosion which leads to a poor durability thereof.

Therefore, it is thought that the ground electrode is formed with a two-layer structure comprised of an outer layer comprised of a nickel alloy, which is excellent in oxidation resistance, and an inner layer comprised of a metal having a better thermal conductivity (e.g., copper-system metal) than that of the outer layer. However, when the materials constituting the outer layer and the inner layer differ, a deformation (i.e., "spring back") of the ground electrode tends to occur due to a difference in the coefficient of thermal expansion between the outer layer and the inner layer, thereby possibly influencing the spark discharge gap. Specifically, a defect of the spark plug caused by such deformation is likely to occur when an outer diameter of the ground electrode is relatively small (e.g., 2 mm or less).

SUMMARY OF THE INVENTION

The present invention has been accomplished in view of the above problems, and an object of the invention is to provide a spark plug for use in an internal-combustion engine which is capable of preventing an inflow of an air-fuel mixture to a spark discharge gap so as to prevent poor ignitability, as well as preventing any influence on the spark discharge gap and improving the durability of the spark plug.

Hereinafter, suitable compositions for solving the above-mentioned problems will be described in accordance with a topic. It is noted that an appropriate effect of the invention will be added to a corresponding composition if needed.

Composition 1. A spark plug according to this composition is comprised of: a center electrode; an insulator provided so as to cover the surroundings of the center electrode; a cylindrical metal shell provided so as to cover the surroundings of the insulator; a ground electrode so disposed that one end thereof is joined to a front-end face of the metal shell and the other end thereof faces the front-end face of the center electrode; and a spark discharge gap formed between the front-end face of the center electrode and a front-end portion of the ground electrode, wherein the ground electrode is constituted so as to reduce its width toward a back face thereof, which is opposed to the center electrode side, at least in a front-end portion thereof located at a front-end side from a center of the spark discharge gap, wherein at least a portion of the ground electrode where sparks are discharged has an outer layer made of a nickel alloy and an inner layer made of pure copper or a copper alloy having a better thermal conductivity than that of the outer layer, and wherein a ratio of a cross-sectional area of the inner layer to the entire cross-sectional area of the ground electrode is 10% or more to 35% or less.

Composition 2. A spark plug according to this composition is comprised of: a center electrode; an insulator provided so as to cover the surroundings of the center electrode; a cylindrical metal shell provided so as to cover the surroundings of the insulator; a ground electrode so disposed that one end thereof is joined to a front-end face of the metal shell and the other end thereof faces the front-end face of the center electrode; and a spark discharge gap formed between the front-end face of the center electrode and a front-end portion of the ground electrode, wherein the ground electrode has a width of 2 mm or less at least in the front-end portion thereof located at a front-end side from a center of the spark discharge gap and a convex-shaped curved face at a back face thereof located opposed to the center electrode side, wherein at least a portion of the ground electrode where sparks are discharged has an outer layer made of a nickel alloy and an inner layer made of pure copper or a copper alloy having a better thermal conductivity than that of the outer layer, and wherein a ratio of a cross-sectional area of the inner layer to the entire cross-sectional area of the ground electrode is 10% or more to 35% or less.

It is noted that a noble metal tip may be provided on at least either the ground electrode or the center electrode. When a noble metal tip is provided only on the center electrode, the spark discharge gap is formed between the noble metal tip and the ground electrode which are opposed to each other. When a noble metal tip is formed only on the ground electrode, the spark discharge gap is formed between the noble metal tip and the center electrode which are opposed to each other. When a noble metal tip is provided on both the ground electrode and the center electrode, the spark discharge gap is formed between the noble metal tips which are opposed to each other. On the other hand, when no noble metal tip is provided on the center electrode or the ground electrode, the spark discharge gap is formed between the front-end face of the center electrode and an inner side face of the ground electrode which are opposed to each other.

Further, the ground electrode does not necessary assume a circular form in the cross-section, but may be constituted so as to reduce its width toward the back face thereof, which is opposed to the center electrode side, at least in the front-end portion thereof located at the front-end side from the center of the spark discharge gap. Thus, the convex-shaped curved face may be formed at the back face of the ground electrode which is opposed to the center electrode side. When the ground electrode is constituted to have such a reduced width at least at the back face thereof, an air-fuel mixture is likely to flow into the inner side of the ground electrode whereby the air-fuel mixture can easily reaches the spark discharge gap. Further, in a conventional ground electrode assuming a rectangular form in the cross-section, "reduced width" means that it is not a constitution where a corner of the ground electrode is simply chamfered, but a constitution where ¼ or more of the width is reduced along a direction perpendicular to the width (i.e., a thickness of the ground electrode).

Further, a "width" referred to in this document means a width in a direction perpendicular to the longitudinal direction of the spark plug (i.e., the direction parallel to the front-end face of the metal shell) and is a projection width when the ground electrode is viewed from the center electrode (the front-end face of the ground electrode). Furthermore, a "copper alloy" in this document is an alloy containing over 50% by mass of copper.

According to the compositions 1 and 2, the ground electrode is constituted so as to reduce its width toward the back face thereof at least in the front-end portion thereof located at the front-end side from the center of the spark discharge gap (in the composition 2, particularly, the ground electrode has a width of 2 mm or less and a convex-shaped curved face at the back face thereof which is opposed to the center electrode side). Thus, the air-fuel mixture can easily reaches the spark discharge gap by flowing to the inner side of the ground electrode, even in a case where the air-fuel mixture is directly exposed to the back face of the ground electrode. As a result, a poor ignitability of the spark plug can be prevented.

At least a portion of the ground electrode where sparks are discharged has an outer layer made of a nickel alloy and an inner layer made of pure copper or a copper alloy having a better thermal conductivity than that of the outer layer. Having such an outer layer, durability against oxidization is improved. Also, having such an inner layer, heat sinking ability becomes favorable and it is possible to prevent a failure due to a temperature rise of the ground electrode at the time of high-speed driving, such as an increment of the spark discharge gap due to an erosion of the ground electrode.

According to the composition 1, in, at least a portion of the ground electrode where sparks are discharged, a ratio of a cross-sectional area of the inner layer to the entire cross-sectional area of the ground electrode is 10% or more to 35% or less. In the case where the ratio of the cross-sectional area of the inner layer to the entire cross-sectional area of the ground electrode is less than 10%, heat sinking ability is not sufficient and a magnitude of the erosion of the ground electrode becomes large. On the other hand, when the ratio of the cross-sectional area of the inner layer to the entire cross-sectional area of the ground electrode exceeds 35%, a deformation (i.e., "spring back") of the ground electrode tends to occur due to a difference in the coefficient of thermal expansion between the outer layer and the inner layer, thereby possibly having an influence on a spark discharge gap. According to the composition 1 where the ratio of a cross-sectional area of the inner layer to the entire cross-sectional area of the ground electrode is 10% or more to 35% or less, heat sinking ability becomes favorable and a spring back of the ground electrode can be prevented, thereby preventing the erosion of the ground electrode and the influence on the spark discharge gap due to the spring back. As a result, the durability of the spark plug can be improved.

Composition 3. A spark plug according to this composition is comprised of: a center electrode; an insulator provided so as to cover the surroundings of the center electrode; a cylindrical metal shell provided so as to cover the surroundings of the insulator; a ground electrode so disposed that one end thereof is joined to a front-end face of the metal shell and the other end thereof faces the front-end face of the center electrode; and a spark discharge gap formed between the front-end face of the center electrode and a front-end portion of the ground electrode, wherein the ground electrode has a width of 2 mm or less and is constituted so as to reduce its width toward a back face thereof, which is opposed to the center electrode side, at least in the front-end portion thereof located at a front-end side from a center of the spark discharge gap, wherein at least a portion of the ground electrode where sparks are discharged has an outer layer made of a nickel alloy and an inner layer made of pure copper or a copper alloy having a better thermal conductivity than that of the outer layer, and wherein a ratio of a cross-sectional area of the inner layer to the entire cross-sectional area of the ground electrode is 20% or more, and wherein the outer layer has a thickness of 0.2 mm or more.

Composition 4. A spark plug according to this composition is comprised of: a center electrode; an insulator provided so as to cover the surroundings of the center electrode; a cylindrical metal shell provided so as to cover the surroundings of the insulator; and a ground electrode disposed so that one end thereof is joined to a front-end face of the metal shell and the other end thereof faces the front-end face of the center electrode. The spark plug further comprises: a spark discharge gap formed between the front-end face of the center electrode and a front-end portion of the ground electrode, wherein the ground electrode has a width of 2 mm or less at least in the front-end portion thereof located at a front-end side from a center of the spark discharge gap and a convex-shaped curved face at a back face thereof located opposed to the center electrode side, wherein at least a portion of the ground electrode where sparks are discharged has an outer layer made of a nickel alloy and an inner layer made of a nickel alloy or pure nickel having a higher purity and a better thermal conductivity than that of the outer layer, in which a ratio of a cross-sectional area of the inner layer to the entire cross-sectional area of the ground electrode is 20% or more, and a thickness of the outer layer is 0.2 mm or more.

Basically, the compositions 3 and 4 can obtain a similar effect as that of the composition 1. Specifically, at least a portion of the ground electrode where sparks are discharged has an outer layer made of a nickel alloy and an inner layer made of pure nickel or a nickel alloy having a higher purity and a better thermal conductivity than that of the outer layer. Having such an outer layer, durability against oxidization is improved. Also, having such an inner layer, heat sinking ability becomes favorable, and it is possible to prevent a failure due to a temperature rise of the ground electrode at the time of high-speed driving, such as an increment of the spark discharge gap due to an erosion of the ground electrode.

According to the compositions 3 and 4, in at least a portion of the ground electrode where sparks are discharged, the ratio of a cross-sectional area of the inner layer to the entire cross-sectional area of the ground electrode is 20% or more, and a thickness of the outer layer is 0.2 mm or more. In the case where the ratio of the cross-sectional area of the inner layer to the entire cross-sectional area of the ground electrode is less than 20%, heat sinking ability is not favorable and a magnitude of the erosion of the ground electrode becomes large. On the other hand, even though the ratio of the cross-sectional area of the inner layer to the entire cross-sectional area of the ground electrode is made larger to some degree than that of the composition 1, an influence on the ground electrode due to a difference in the coefficient of thermal expansion between the outer layer and the inner layer is small, because both layers contains nickel. However, when the ratio of the cross-sectional area of the inner layer to the entire cross-sectional area of the ground electrode is made considerably large, the thickness of the outer layer becomes small. The thin outer layer may cause a fracture. On the other hand, according to the composition 2 which has the ratio of a cross-sectional area of the inner layer to the entire cross-sectional area of the ground electrode is 20% or more, and a thickness of the outer layer is 0.2 mm or more, heat sinking ability becomes favorable, thereby preventing the erosion of the ground electrode and the fracture of the outer layer. As a result, the durability of the spark plug can be improved.

Regarding the thickness of the outer layer, it is desirable to provide the following composition 5.

Composition 5. In any one of the compositions 1 to 4, a spark plug according to a composition 5, provided that the distance of the spark discharge gap is taken as G (mm), the diameter of the front-end portion of the center electrode is taken as D (mm) and the distance between a point nearest to the center electrode in the outer layer and a point nearest to the center electrode in the inner layer is taken as T0 (mm) when the ground electrode is projected from the front-end face side thereof along a central axis of the center electrode, wherein the distance T0 satisfies the expression 0.2 mm≦T0≦0.5 mm within a range of ±[(D/2)+G] from the central axis of the center electrode.

Here, the range of ±[(D/2)+G] is a range mainly corresponding to "a portion where the spark discharge is performed" i.e., a range where the spark discharge is easily generated in any one of compositions 1 to 4. In the composition 5, provided that the distance between the point nearest to the center electrode in the outer layer and the point nearest to the center electrode in the inner layer is taken as T0 (mm) when the ground electrode is projected from the front-end face side thereof along a central axis of the center electrode, the distance T0 satisfies the expression 0.2 mm≦T0≦0.5 mm. When the distance T0 is less than 0.2 mm, there is a possibility that the thin outer layer might suffer a tear (fracture). On the other hand, when the distance T0 exceeds 0.5 mm, as the inner layer having excellent heat dispersion is away from the spark discharge gap, a portion in the ground electrode where the spark discharge is performed tends to be at a high temperature. As a result, an increment of the spark discharge gap due to an erosion of the ground electrode is likely to occur. However, according to the composition 5 which satisfies the expression 0.2≦T0≦0.5, the heat sinking ability becomes favorable, thereby preventing an influence on the spark discharge gap due to the erosion of the ground electrode, as well as preventing the fracture of the outer layer. As a result, the durability of the spark plug can be improved.

The inner layer may be made eccentric with respect to the ground electrode. In this case, it is desirable to have the following composition 6.

Composition 6. In any one of the compositions 1 to 5, a spark plug according to a composition 6, provided that the ground electrode and the center electrode are projected from the front-end face side of the ground electrode along the central axis of the center electrode, tangent lines are drawn from two outer rims of the front-end of the center electrode, respectively, so as not to intersect with each other with respect to a periphery line of the ground electrode, and the periphery line is divided in two parts by contact points to define one part as a center electrode side and the other part as a back face side, wherein the inner layer is made eccentric so that a thinnest portion of the outer layer is located at the back face side of the ground electrode.

According to the composition 6, the inner layer is made eccentric so that the thinnest portion of the outer layer is located at the back face side of the ground electrode. Thus, more effective heat sinking ability can be expected because the inner layer having an excellent heat dispersion is made eccentric at the back face side of the ground electrode where a combustion chamber is closely disposed. Especially, in satisfying the composition 5, the fracture of the portion where the spark discharge is generated can be prevented and the effective heat sinking ability in the combustion chamber is facilitated because the inner layer is not made extremely eccentric but is made eccentric to some extent.

Further, the inner layer may be made eccentric with respect to the ground electrode as follows.

Composition 7. A spark plug according to this composition, provided that an outer edge of a front-end portion of the ground electrode, an inner layer formed in the ground electrode and the center electrode are projected from the front-end face side of the ground electrode along the central axis of the center electrode, tangent lines are drawn from two outer rims of the front-end of the center electrode, respectively so as not to intersect with each other with respect to a periphery line of the ground electrode, and the front-end portion of the ground electrode are divided by, including a segment which connects both contact points of the tangent lines, a planar face perpendicular to the front-end face of the ground electrode into two portions: an inner side portion serving as a center electrode side; and an outer side portion serving as an opposed side to the center electrode, wherein, in the front-end portion of the ground electrode, a volume Vo of an outer side inner layer with respect to the outer side portion is larger than a volume Vi of an inner side inner layer with respect to the inner side portion.

According to the composition 7, it is possible that the inner layer formed in the front-end portion of the ground electrode is made eccentric toward outer side, as well as disposed at the inner side. With this composition, the outer side inner layer of the front-end portion of the ground electrode actively conducts heat from a portion near the center of a combustion chamber to a metal shell. Further, since the front-end portion of the ground electrode has the inner side inner layer, it is possible to avoid releasing heat, which is received by the outer side outer layer from the center of the combustion chamber, through the inner side of the front-end portion of the ground electrode, thereby resulting in preventing any ignitability failure caused by drawing significant heat from an initial flame kernel formed between the spark discharge gap. Furthermore, when a noble metal tip joined to the ground electrode is exposed in the spark discharge gap, it is possible to avoid an extreme heat cycle in use, thereby improving the durability of the tip.

BRIEF DESCRIPTION OF THE DRAWINGS

Embodiments of the invention will now be described, by way of example only, with reference to the accompanying drawings in which.

DETAILED DESCRIPTION OF PREFERRED EMBODIMENTS

Figure 1:
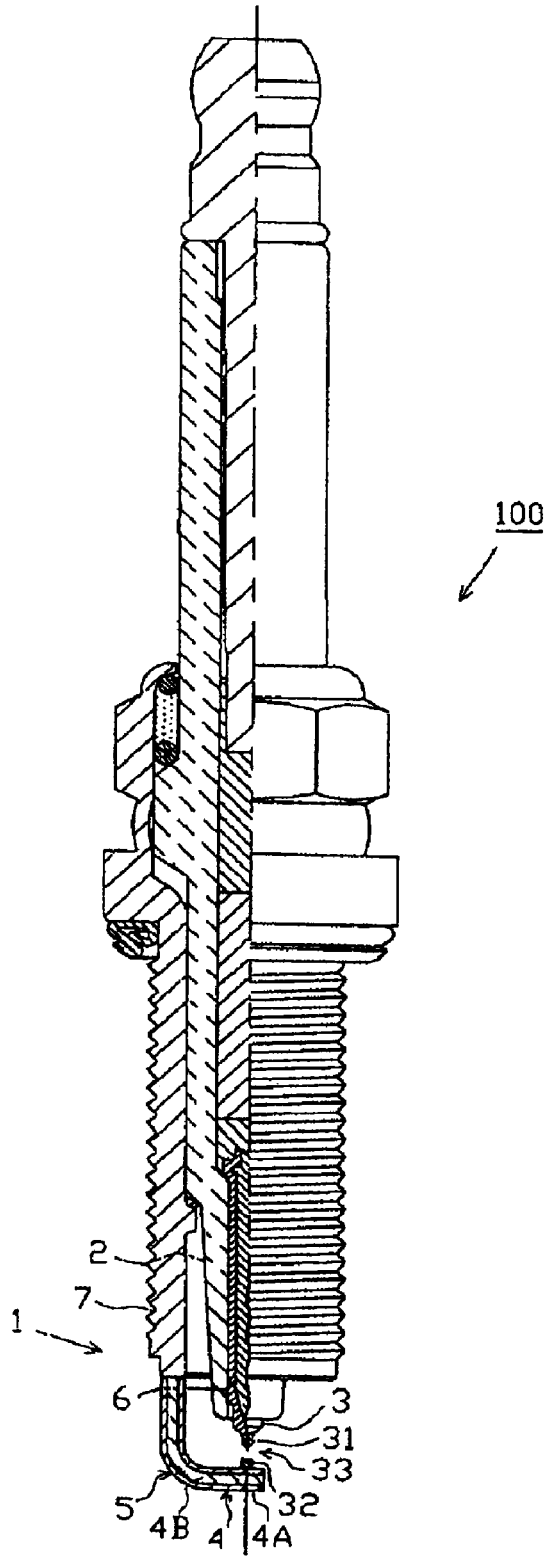
FIG. 1 is a partially sectional front view showing an entire composition of a spark plug according to an embodiment of the invention.
Figure 2:
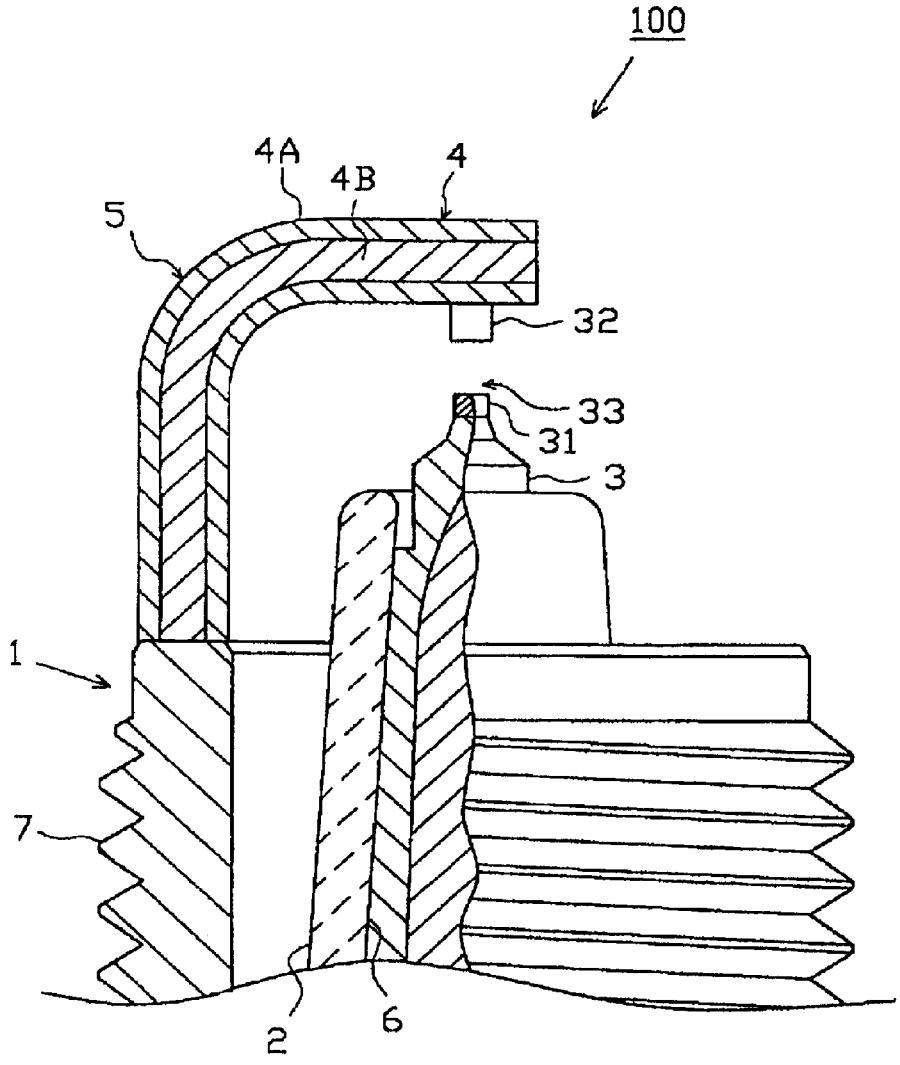
FIG. 2 is a partially sectional front view showing a composition of a main portion of a spark plug according to the embodiment.

A first embodiment of the present invention will be described with reference to the drawings. FIG. 1 is a partially sectional front view showing an entire composition of a spark plug according to this embodiment, and FIG. 2 is a partially sectional front view showing a composition of a main portion. Hereinafter, the present invention will be described with reference to mainly FIG. 2.

As shown in FIG. 2 or the like, a spark plug 100 according to this embodiment is comprised of a metal shell 1, an insulator 2, a center electrode 3 and a ground electrode 4. There is also provided a contact terminal or the like electrically connected to the center electrode 3 through a resistor or a glass seal portion at a rear-end side of the insulator 2, even though no numeral is particularly attached thereto. The metal shell 1 assumes a cylindrical form and holds the insulator 2 therein through talc, a packing or the like. A front-end portion of the insulator 2 projects from the metal shell 1. The center electrode 3 is disposed inside the insulator 2 so that a noble-metal tip 31 formed at a front-end of the center electrode 3 projects from the insulator 2. Further, a rear-end face of the ground electrode 4 is welded to a front-end face of the metal shell 1 and a bent portion 5 positioned in a middle section of the ground electrode 4 in the longitudinal direction is bent toward the central direction. The ground electrode 4 is arranged so that a front-end portion inner side face thereof faces the front-end face of the center electrode 3. A noble metal tip 32 facing the noble metal tip 31 is formed in the inner side face of the ground electrode 4. Furthermore, a gap formed between the noble metal tip 31 and the noble metal tip 32 serves as a spark discharge gap 33.

The insulator 2 is comprised of a ceramic sintered compact made of, for example, alumina, and a pore 6 for accommodating the center electrode 3 is formed therein along the axial direction of the insulator 2. The metal shell 1 assumes a cylindrical form and is made of a metal, such as low carbon steel. Further, the metal shell 1 constitutes a housing of the spark plug 100, and has an outer circumference face forming a screw portion 7 for mounting the spark plug 100 on a cylinder head of the engine (not illustrated).

The main body of the ground electrode 4 has a two-layer structure comprised of an outer layer 4A and an inner layer 4B. The outer layer 4A in this embodiment is comprised of a nickel alloy, such as INCONEL 600® and INCONEL 601®. On the other hand, the inner layer 4B is comprised of pure copper having a better thermal conductivity than that of the nickel alloy. Such the inner layer 4B can facilitate a heat sinking ability of the ground electrode 4 (later described in detail). In this embodiment, the main body of the center electrode 3 also has a two-layer structure comprised of an outer layer and an inner layer.

The noble metal tip 31 formed on the center electrode 3 is comprised of a noble alloy that contains, for example, iridium as a main component, platinum-10% by mass, rhodium-3% by mass and nickel-1% by mass. The noble metal tip 32 formed on the ground electrode 4 is comprised of a noble alloy that contains, for example, platinum as a main component, iridium-20% by mass and rhodium-5% by mass. However, these components are only the examples and there is no limitation with respect to the components. Each noble metal tip 31, 32 formed in a predetermined shape (e.g., a columnar shape) is welded along an outer edge contact face thereof to the metal shell 3 or the ground electrode 4 by a laser welding, an electron beam welding, a resistance welding or the like.

Although the noble metal tips 31 and 32 are formed on the center electrode 3 and the ground electrode 4, respectively, in this embodiment, the noble metal tip may be provided on either the ground electrode 4 or the center electrode 3. When the noble metal tip 31 is formed only on the center electrode 3, the spark discharge gap is formed between the noble metal tip 31 and the ground electrode 4 which are opposed to each other. When the noble metal tip 32 is formed only on the ground electrode 4, the spark discharge gap is formed between the noble metal tip 32 and the center electrode 3 which are opposed to each other. On the other hand, when no noble metal tip is provided on the center electrode 3 or the ground electrode 4, the spark discharge gap is formed between the front-end face of the center electrode 3 and an inner side face of the ground electrode 4 which are opposed to each other.

Figure 3:
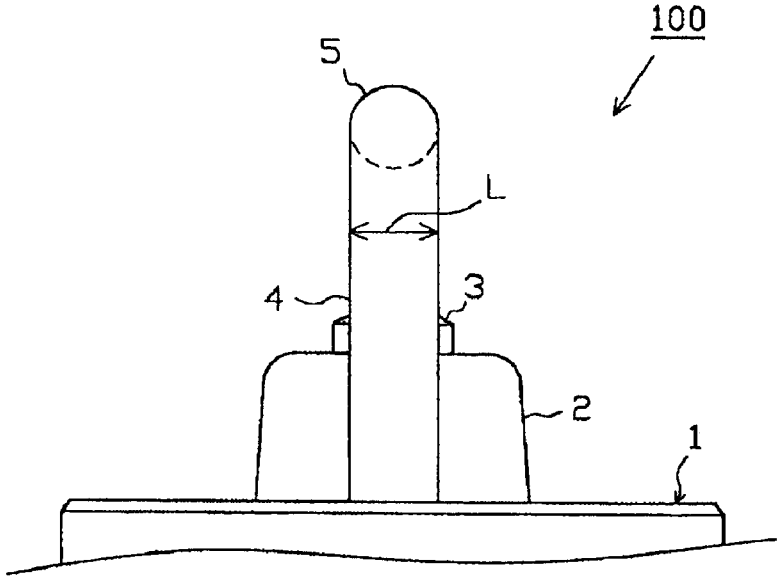
FIG. 3 is a side view showing a spark plug viewed from the direction perpendicular to the direction of FIG. 2.
Figure 4:
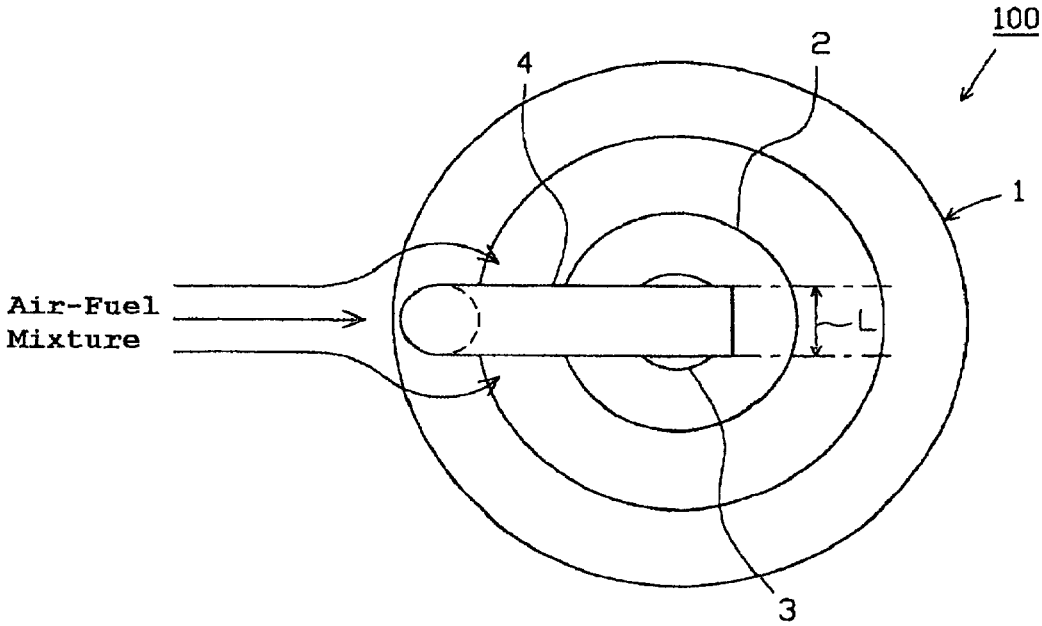
FIG. 4 is a top view showing a spark plug viewed from a front-end side.

The ground electrode 4 according to this embodiment has the two-layer structure in which a main body portion is comprised of the outer layer 4A and the inner layer 4B as mentioned above. As shown in FIGS. 2, 3 and 4, the ground electrode 4 assumes a circular form in the cross-section and an outer diameter L thereof is 2 mm or less (e.g., 1.7 mm) [i.e., the width in the direction perpendicular to the longitudinal direction of the spark plug 100 (the direction parallel to the front-end face of the metal shell) which is a projection width when the ground electrode 4 is viewed from the center electrode 3 (front-end face of the ground electrode 4)].

As described above, the outer layer 4A is comprised of the nickel alloy, and the inner layer 4B is comprised of pure copper. The inner layer 4B reaches (is exposed to) the front-end face of the ground electrode 4 and the ratio of the cross-sectional area of the inner layer 4B to the entire cross-sectional area of the ground electrode 4 falls within the range of 10% or more to 35% or less (e.g., 25% in this embodiment).

Figure 5A:
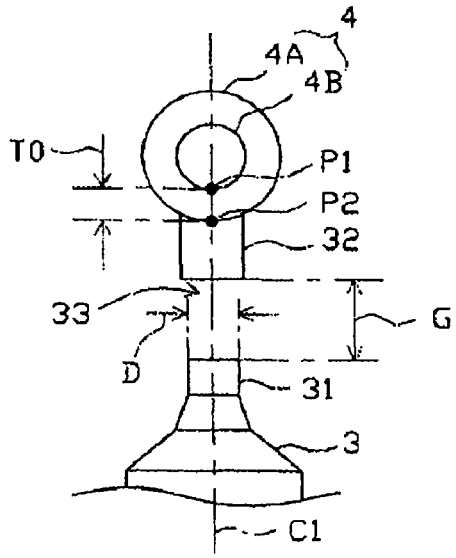
FIG. 5A is a diagram showing a ground electrode and a center electrode which are projected from a front-end face side of the ground electrode along the central axis of the center electrode.
Figure 5B:
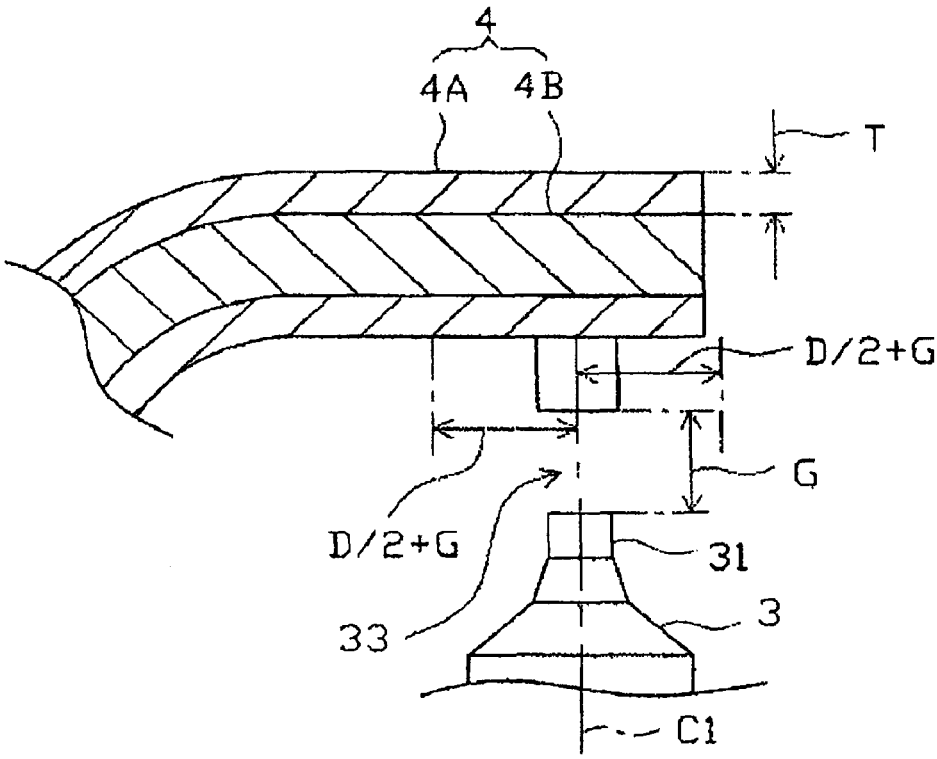
FIG. 5B is an explanatory view showing an enlarged main portion of FIG. 2.

As shown in FIGS. 5A, 5B, provided that the distance of the spark discharge gap 33 is taken as G (mm), the diameter of the front-end portion (the noble metal tip 31 in this embodiment) of the center electrode 3 is taken as D (mm) and the distance between a point P2 nearest to the center electrode 3 in the outer layer 4A and a point P1 nearest to the center electrode 3 in the inner layer 4B is taken as T0 (mm) when the ground electrode 4 is projected from the front-end face side thereof along a central axis C1 of the center electrode 3, the distance T0 is greater than or equal to 0.2 mm and less than or equal to 0.5 mm within a range of ±[(D/2)+G] from the central axis C1 of the center electrode 3 (i.e., within the range where the spark discharge is easily generated).

A method for manufacturing the spark plug 100 constructed as mentioned above will be briefly described. First, the metal shell 1 is prepared beforehand. That is, a through-hole is provided in a columnar-shaped metal material (e.g., iron-system material or a stainless steel material, such as S15C or S25C) using a cold forging processing to produce a primary body of the metal shell 1. Then, an outer shape of thus-produced body is arranged by a cutting process to form a metal shell intermediate body.

Next, the ground electrode 4 is joined to the front-end portion of the metal shell intermediate body by a resistance welding. The ground electrode 4 welded at this time assumes a straight rod-like shape and has not been bent yet. For example, the ground electrode 4 may be obtained as follows. In a first step, the copper core constituting the inner layer 4B is disposed in a nickel alloy cup, which constitutes the outer layer 4A, or inserted in a cylindrical nickel alloy body to thereby form a cup-shape assembly or a cylindrical assembly having a core-in-sheath structure. Then, thus-formed assembly is subjected to an extrusion molding using a mold or the like so as to thin down somewhat with a diameter being a little larger than that of a final diameter. Next, in a second step, the intermediate material is subjected to a swaging process to thin down the diameter thereof. It is noted that a wire drawing process using a die or the like may be employed to thin down the intermediate material, instead of the swaging process. Thus, the straight rod-like ground electrode 4 comprised of the outer layer 4A and the inner layer 4B is produced.

In addition, since the resistance welding causes so-called "rundown," a screw portion 7 is formed after removing the "rundown" in a predetermined location of the intermediate metal shell by rolling process. In this way, the metal shell 1 to which the ground electrode 4 is welded is produced. Galvanization or nickel plating is applied to the metal shell 1 to which the ground electrode 4 is welded. It is noted that the thus-plated metal shell 1 may be further subjected to a chromate treatment in order to improve corrosion-resistant thereof.

Further, the noble metal tip 32 is joined to the front-end portion of the ground electrode 4 by resistance welding, laser welding or the like. In order to achieve a secure welding, plating in a welded area is removed prior to the welding process, or alternatively, a masking is applied to an area for welding in the plating process. Further, the tip welding may be performed after an assembly process (later described).

On the other hand, the insulator 2 is formed by molding process, separately from the metal shell 1. For example, a raw granulated body for molding is prepared using a raw powder mixture of alumina as a main component and a binder or the like. The granulated body is subjected to a rubber pressing to form a cylindrical mold. Then, thus-formed mold is subject to a grinding process so as to machine the exterior thereof. The thus-ground mold is sintered in a furnace to complete the insulator 2.

The center electrode 3 is manufactured separately from the metal shell 1 and the insulator 2. That is, the forging process is performed to a nickel alloy, and a copper core is disposed in the center of thus-forged alloy in order to improve heat dispersion. Then, the noble metal tip 31 is joined to the front-end portion of the core by a resistance welding, a laser welding or the like.

Then, the thus-formed center electrode 3 having the noble metal tip 31 and a terminal fitting (not illustrated) are disposed and fixed in the pore 6 of the insulator 2 through the glass seal material (not illustrated). Generally, a mixture of borosilicate glass and metallic powder is used as a glass seal. Then, while the center electrode 3 is accommodated in the pore 6 of the insulator 2, the prepared glass seal is charged into the pore 6 of the insulator 2. Thereafter, the terminal fitting is pressed into the pore 6 from the rear side, and the thus-assembled body is fired in the furnace. At this time, a glaze layer formed on a surface of a drum portion of the insulator 2 at the rear-end side may be simultaneously fired, or the glaze layer may be formed beforehand.

Thereafter, the thus-formed center electrode 3, the thus-formed insulator 2 provided with the terminal fitting and the metal shell 1 including the ground electrode 4 are assembled. More particularly, the rear-end portion of the metal shell 1 relatively formed thin is subjected to a cold caulking or a hot caulking so that a part of the insulator 2 is enclosed and held by the metal shell 1 from the circumferential direction.

Finally, the spark discharge gap 33 formed between the center electrode 3 (the noble metal tip 31) and the ground electrode 4 (the noble metal tip 32) is formed and defined by bending the ground electrode 4.

Through a series of these processes, the spark plug 100 having the above-mentioned composition is manufactured.

Next, various samples each having a different condition were produced in order to evaluate the effect of the first embodiment. The result will be described below.

Figure 6:
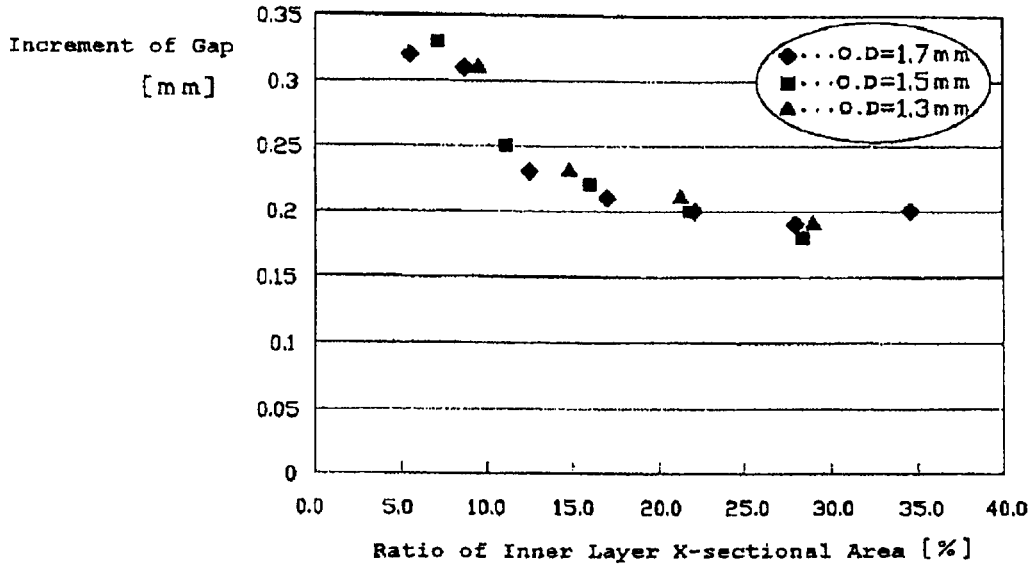
FIG. 6 is a graph showing a relationship between an increment of gap and a cross-sectional area ratio of an inner layer according to a first embodiment.

Samples (the spark plugs) with three types of ground electrodes with an outer diameter L of 1.7 mm, 1.5 mm and 1.3 mm were prepared. Also, each type of the samples had a different inner layer diameter (cross-sectional area). The sample was mounted on an inline four-cylinder engine having a displacement of 2000 cc, and a durability test with a 100,000 km run was conducted. It is noted that a diameter D of the noble metal tip of the center electrode was 0.6 mm, and the iridium alloy (Ir-5Pt) was employed as a material for the noble metal tip. The evaluation results (regarding the presence/absence of the spring back, an increment of a spark discharge gap (hereinafter referred to as a "gap" for the sake of convenience) are shown in Tables 1, 2 and 3, when the outer diameter L is 1.7 mm, 1.5 mm and 1.3 mm, respectively. Further, the relationship between the increment of the gap and the ratio of the cross-sectional area of the inner layer to the cross-sectional area of the ground electrode is shown in FIG. 6.

The ratio of the cross-sectional area of the inner layer to the cross-sectional area of the ground electrode was measured as follows. First, an image of the ground electrode was taken from the front-end direction to measure the cross-sectional area thereof. After conducting the durability test, the cross-section of the center line (the direction where the front-end portion extends) of the ground electrode including the center line of the center electrode was observed so as to measure the cross-sectional area of the inner layer. Here, based on these two values, the ratio of the inner layer cross-sectional area was calculated. The above-described method is only adoptable when the ground electrode has a uniform diameter. However, when a cross-sectional area of the ground electrode differs along the longitudinal direction, a method such as a three-dimensional transmission imaging (so-called CT scan) may be adopted.

Regarding the "spring back" in Tables, when any deformation of the ground electrode is observed after the durability test, it is indicated as "yes". When no deformation is observed, it is indicated as "no". Regarding the increment of the gap, when the increment of the gap is 0.3 mm or more, the discharge voltage of the spark plug rises rapidly (i.e., high voltage is required for an electric discharge), whereby an erosion of the electrode is accelerated as a magnitude of the impact on the electrode becomes large at the time of the electric discharge. Thus, the increment of the gap after the durability test of a 100,000 km run is necessarily controlled to be less than 0.3 mm. When any spring back occurred in the evaluation, the increment of the gap was not measured.

TABLE 1

| | Sample No. | | | | | | | | | |
|---|---|---|---|---|---|---|---|---|---|---|
| | 1 | 2 | 3 | 4 | 5 | 6 | 7 | 8 | 9 | 10 |
| Outer Diameter [mm] | 1.7 | | | | | | | | | |
| Inner Layer Dia. [mm] | 0.4 | 0.5 | 0.6 | 0.7 | 0.8 | 0.9 | 1.0 | 1.1 | 1.2 | 1.3 |
| Ratio of Inner Layer X-Sectional Area [mm] | 5.5 | 8.7 | 12.5 | 17.0 | 22.1 | 28.0 | 34.6 | 41.9 | 49.8 | 58.5 |
| Spring Back | No | No | No | No | No | No | No | Yes | Yes | Yes |
| Increment of Gap [mm] | 0.32 | 0.31 | 0.23 | 0.21 | 0.20 | 0.19 | 0.20 | — | — | — |

TABLE 2

| | Sample No. | | | | | | | |
|---|---|---|---|---|---|---|---|---|
| | 11 | 12 | 13 | 14 | 15 | 16 | 17 | 18 |
| Outer Diameter [mm] | 1.5 | | | | | | | |
| Inner Layer Dia. [mm] | 0.4 | 0.5 | 0.6 | 0.7 | 0.8 | 0.9 | 1.0 | 1.1 |
| Ratio of Inner Layer X-sectional Area [%] | 7.1 | 11.1 | 16.0 | 21.8 | 28.4 | 36.0 | 44.4 | 53.8 |
| Spring Back | No | No | No | No | No | Yes | Yes | Yes |
| Increment of Gap [mm] | 0.33 | 0.25 | 0.22 | 0.20 | 0.18 | — | — | — |

TABLE 3

| | Sample No. | | | | | |
|---|---|---|---|---|---|---|
| | 19 | 20 | 21 | 22 | 23 | 24 |
| Outer Diameter [mm] | 1.3 | | | | | |
| Inner Layer Dia. [mm] | 0.4 | 0.5 | 0.6 | 0.7 | 0.8 | 0.9 |
| Ratio of Inner Layer X-sectional Area [%] | 9.5 | 14.8 | 21.3 | 29.0 | 37.9 | 47.9 |
| Spring Back | No | No | No | No | Yes | Yes |
| Increment of Gap [mm] | 0.31 | 0.23 | 0.21 | 0.19 | — | — |

As shown in Tables 1 to 3 and FIG. 6, in the case where the ratio of the cross-sectional area of the inner layer 4B to the cross-sectional area of the ground electrode 4 is less than 10% (Samples 1, 2 in Table 1, Sample 11 in Table 2 and Sample 19 in Table 3), the increment of the gap was 0.3 mm or more. When the ratio of the cross-sectional area of the inner layer to the cross-sectional area of the ground electrode exceeds 35% (Samples 8, 9, 10 in Table 1, Samples 16, 17, 18 in Table 2, Samples 23, 24 in Table 3), the spring back was observed. On the other hand, when the ratio of the cross-sectional area of the inner layer to the cross-sectional area of the ground electrode was in the range of 10% or more to 35% or less (Samples 3, 4, 5, 6, 7 in Table 1, Samples 12, 13, 14, 15 in Table 2, and Samples 20, 21, 22 in Table 3), neither any increment of the gap of 0.3 mm or more nor any spring back was observed.

According to this embodiment, in the case where the ratio of the cross-sectional area of the inner layer 4B to the entire cross-sectional area of the ground electrode 4 falls within the range of 10% to 35%, the heat sinking ability becomes favorable, and the spring back of the ground electrode can be prevented, thereby preventing the erosion of the ground electrode 4, as well as preventing the influence on the spark discharge gap due to the spring back. As a result, the durability of the spark plug can be improved.

Next, a second embodiment of the present invention will be described. In this embodiment, any portions similar to the first embodiment are given by similar reference numbers, and detailed explanation thereof is omitted. Mainly the different portions from those of the first embodiment will be described.

The spark plug according to this embodiment is also comprised of a metal shell 1, an insulator 2, a center electrode 3 and a ground electrode 4. In this embodiment, the composition of the ground electrode 4 is different from that of the first embodiment.

Similar to the first embodiment, a main body of the ground electrode 4 has a two-layer structure comprised of an outer layer 4A and an inner layer 4B, and the outer layer 4A in this embodiment is also comprised of a nickel alloy, such as INCONEL 600® or the like. On the other hand, the inner layer 413 in the second embodiment is comprised of high purity nickel (e.g., pure nickel: including indispensable components) having a better thermal conductivity than that of the outer layer 4A.

The ground electrode 4 according to the second embodiment also assumes a circular form in the cross-section and an outer diameter L [i.e., the width in the direction perpendicular to the longitudinal direction of the spark plug 100 (the direction parallel to the front-end face of the metal shell) which is a projection width when the ground electrode 4 is viewed from the center electrode 3 (front-end face of the ground electrode 4)] thereof is 2 mm or less (e.g., 1.7 mm).

Further, the ratio of the cross-sectional area of the inner layer 4B to the entire cross-sectional area of the ground electrode 4 is set to be 20% or more (e.g., 25% in this embodiment). However, although there is no particular limitation with respect to the maximum ratio of the cross-sectional area, a thickness T (refer to FIG. 5B) of the outer layer 4A is set to be 0.2 mm or more.

In the second embodiment, provided that the distance between a point P2 nearest to the center electrode 3 in the outer layer 4A and a point P1 nearest to the center electrode 3 in the inner layer 4B is taken as T0 (mm) when the ground electrode 4 is projected from the front-end face side thereof along a central axis C1 of the center electrode 3, the distance T0 is greater than or equal to 0.2 mm and less than or equal to 0.5 mm within a range of ±[(D/2)+G] from the central axis C1 of the center electrode 3 (i.e., within the range where the spark discharge is easily generated).

Next, similar to the first embodiment, various samples each having a different condition were produced in order to evaluate the effect of the second embodiment. The result will be described below.

Figure 7:
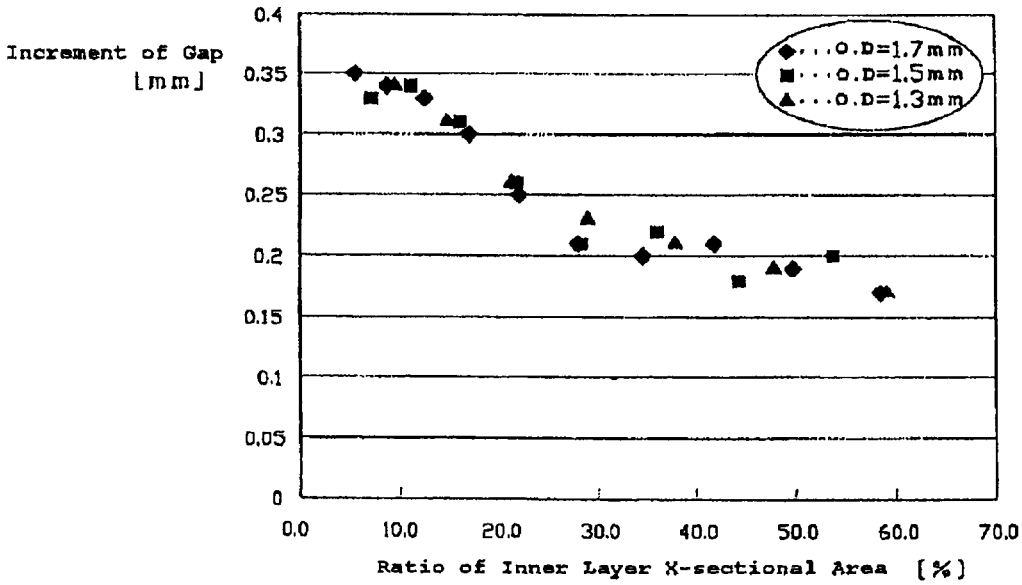
FIG. 7 is a graph showing a relationship between an increment of gap and a cross-sectional area ratio of an inner layer according to a second embodiment.

Samples (the spark plugs) with three types of ground electrodes with an outer diameter L of 1.7 mm, 1.5 mm and 1.3 mm were prepared. Each type of the samples had a different inner layer diameter (cross-sectional area). The sample was mounted on an inline four-cylinder engine having a displacement of 2000 cc, and a durability test of a 100,000 km run was conducted. It is noted that a diameter D of the noble metal tip of the center electrode was 0.6 mm, and the iridium alloy (Ir-5Pt) was employed as a material for the noble metal tip. The evaluation result (regarding a presence/absence of an outer layer fracture and an increment of the gap) is shown in Table 4, 5 and 6, when the outer diameter L is 1.7 mm, 1.5 mm and 1.3 mm, respectively. Further, the relationship between the increment of the gap and the ratio of the cross-sectional area of the inner layer to the cross-sectional area of the ground electrode is shown in FIG. 7.

However, regarding a "fracture of the outer layer", when any fracture occurs, it is indicated as "NG", and when no fracture occurs, it is indicated as "O.K.". Similar to the first embodiment, the increment of the gap is necessarily controlled to be less than 0.3 mm. When any fracture of the outer layer occurs, the increment of the gap was not measured.

TABLE 4

| | Sample No. | | | | | | | | | | | |
|---|---|---|---|---|---|---|---|---|---|---|---|---|
| | 25 | 26 | 27 | 28 | 29 | 30 | 31 | 32 | 33 | 34 | 35 | 36 |
| Outer Diameter [mm] | 1.7 | | | | | | | | | | | |
| Inner Layer Dia. [mm] | 0.4 | 0.5 | 0.6 | 0.7 | 0.8 | 0.9 | 1.0 | 1.1 | 1.2 | 1.3 | 1.4 | 1.5 |
| Ratio of Inner Layer X-sectional Area [%] | 5.5 | 8.7 | 12.5 | 17.0 | 22.1 | 28.0 | 34.6 | 41.9 | 49.8 | 58.5 | 67.8 | 77.8 |
| Fracture of Outer Layer | OK | OK | OK | OK | OK | OK | OK | OK | OK | OK | NG | NG |
| Increment of Gap | 0.35 | 0.34 | 0.33 | 0.30 | 0.25 | 0.21 | 0.20 | 0.21 | 0.19 | 0.17 | — | — |

TABLE 5

| | Sample No. | | | | | | | | | |
|---|---|---|---|---|---|---|---|---|---|---|
| | 37 | 38 | 39 | 40 | 41 | 42 | 43 | 44 | 45 | 46 |
| Outer Diameter [mm] | 1.5 | | | | | | | | | |
| Inner Layer Dia. [mm] | 0.4 | 0.5 | 0.6 | 0.7 | 0.8 | 0.9 | 1.0 | 1.1 | 1.2 | 1.3 |
| Ration of Inner Layer X-sectional Area [%] | 7.1 | 11.1 | 16.0 | 21.8 | 28.4 | 36.0 | 44.4 | 53.8 | 64 | 75.1 |
| Fracture of Outer Layer | OK | OK | OK | OK | OK | OK | OK | OK | NG | NG |
| Increment of Gap | 0.33 | 0.34 | 0.31 | 0.26 | 0.21 | 0.22 | 0.18 | 0.20 | — | — |

TABLE 6

| | Sample No. | | | | | | | |
|---|---|---|---|---|---|---|---|---|
| | 47 | 48 | 49 | 50 | 51 | 52 | 53 | 54 |
| Outer Diameter [mm] | 1.3 | | | | | | | |
| Inner Layer Dia. [mm] | 0.4 | 0.5 | 0.6 | 0.7 | 0.8 | 0.9 | 1.0 | 1.1 |

TABLE 6-continued

| | Sample No. | | | | | | | |
|---|---|---|---|---|---|---|---|---|
| | 47 | 48 | 49 | 50 | 51 | 52 | 53 | 54 |
| Ratio of Inner Layer X-sectional Area [%] | 9.5 | 14.8 | 21.3 | 29.0 | 37.9 | 47.9 | 59.1 | 71.5 |
| Fracture of Outer Layer | OK | OK | OK | OK | OK | OK | NG | NG |
| Increment of Gap | 0.34 | 0.31 | 0.26 | 0.23 | 0.21 | 0.19 | 0.17 | — |

As shown in Tables 4 to 6 and FIG. 7, in the case where the ratio of the cross-sectional area of the inner layer to the cross-sectional area of the ground electrode is less than 20% (Samples 25, 26, 27, 28 in Table 4, Sample 37, 38, 39 in Table 5 and Sample 47, 48 in Table 6), the increment of the gap was 0.3 mm or more. Further, when the thickness of the outer layer was less than 0.2 mm (Samples 35, 36 in Table 4, Samples 45, 46 in Table 5, Samples 53, 54 in Table 6), the fracture of the outer layer occurred. On the other hand, when the ratio of the cross-sectional area of the inner layer to the cross-sectional area of the ground electrode was 20% or more, and the thickness of the outer layer was 0.2 mm or more (Samples 29, 30, 31, 32, 33, 34 in Table 4, Samples 40, 41, 42, 43, 44 in Table 5, and Samples 49, 50, 51, 52 in Table 6), neither any increment of the gap of 0.3 mm or more nor the fracture of the outer layer was observed.

According to this embodiment, in the case where the ratio of the cross-sectional area of the inner layer 4B to the entire cross-sectional area of the ground electrode 4 is 20% or more, and the thickness of the outer layer is 0.2 mm or more, the heat sinking ability becomes favorable, thereby preventing an influence on the spark discharge gap due to the erosion of the ground electrode. As a result, the durability of the spark plug can be improved.

However, the present invention is not limited to the above-described embodiment and may be, for example, carried out as follows.

Figure 8A:
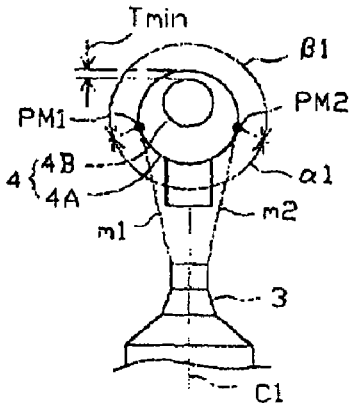
FIGS. 8A, 8B, 8C are explanatory views according to another embodiment and showing a diagram of a ground electrode and a center electrode which are projected from a front-end face side of the ground electrode along the central axis of the center electrode.
Figure 8B:
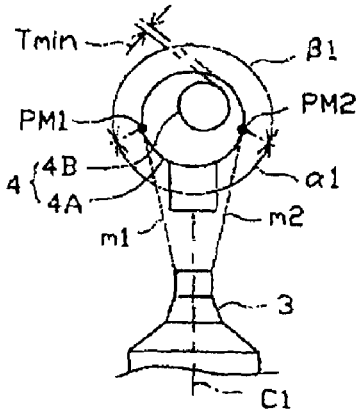
Figure 8C:
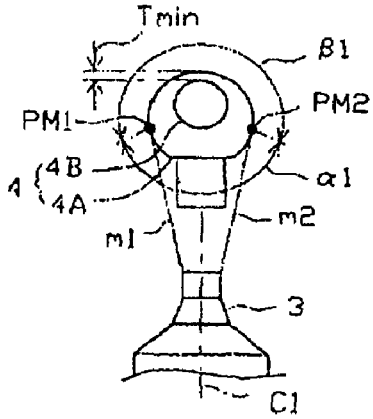

In the above-described embodiments, although the center of the inner layer 4B is aligned with the center of the ground electrode 4, it may be made eccentric, as shown in FIGS. 8A, 8B, 8C. In this case, the following composition is preferably employed.

That is, as shown in FIG. 8, provided that the ground electrode 4 and the center electrode 3 are projected from the front-end face side of the ground electrode 4 along the central axis C1 of the center electrode 3, tangent lines m1, m2 are drawn from two outer rims of the front-end of the center electrode 3, respectively, so as not to intersect with each other with respect to the periphery line of the ground electrode 4, and a periphery line of the ground electrode 4 is divided in two parts by contact points PM1, PM2 to define one part as a center electrode side al and the other part as a back face side β1, the inner layer 4B is made eccentric so that a thinnest portion Tmin of the outer layer 4A is located at the back face side β1.

With this construction, since the inner layer 4B having an excellent heat dispersion is made eccentric at the back face side β1 where a combustion chamber (supposed to exist in the upper side of FIG. 7) of the engine is closely located, more effective heat sinking ability can be expected. As described in the above embodiment, provided that the distance between a point P2 nearest to the center electrode 3 in the outer layer 4A and a point P1 nearest to the center electrode 3 in the inner layer 4B is taken as T0 (mm) when the ground electrode 4 is projected from the front-end face side thereof along a central axis C1 of the center electrode 3, the distance T0 is greater than or equal to 0.2 mm and less than or equal to 0.5 mm within a range of ±[(D/2)+G] from the central axis C1 of the center electrode 3 (i.e., within the range where the spark discharge is easily generated). In satisfying the above-described conditions, the fracture of the portion where the spark discharge is generated can be prevented and the effective heat sinking ability in the combustion chamber is facilitated because the inner layer 4B is not made extremely eccentric but is made eccentric to some extent.

Next, similar to the first and second embodiments, various samples each having a different condition were produced in order to conduct an evaluation. The result will be described below.

Samples (spark plugs) with a circular-shaped ground electrode in the cross-section which has an outer diameter L of 1.7 mm and an inner layer diameter of 0.9 mm were prepared. Further, the center location of the inner layer was altered in each sample. It is noted that a diameter D of the noble metal tip of the center electrode was 0.6 mm, and the iridium alloy (Ir-5Pt) was employed as a material for the noble metal tip. The thus-prepared samples are divided in five categories whose T0 was 0.2 mm, 0.3 mm, 0.4 mm, 0.5 mm and 0.6 mm. The sample was mounted on an inline four-cylinder engine having a displacement of 2000 cc, and a durability test of a 100,000 km run was conducted. The result of the test showed that an adhesion of the noble metal tip improved as T0 became larger. It is considered that the difference in temperature between the noble metal tip and a portion of the ground electrode 4 to which the noble metal tip is joined decrease because the inner layer 4B is away from the noble metal tip.

Figure 9A:
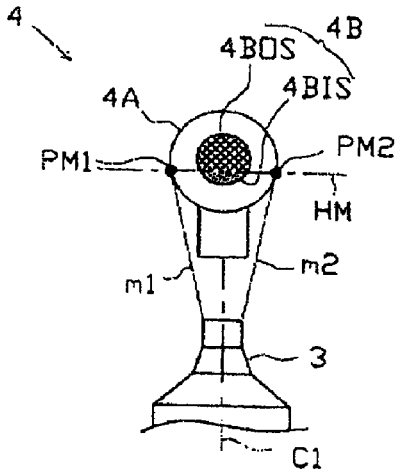
FIGS. 9A and 9B are an explanatory view according to another embodiment and showing a diagram of a ground electrode and a center electrode which are projected from a front-end face side of the ground electrode along the central axis of the center electrode.
Figure 9B:
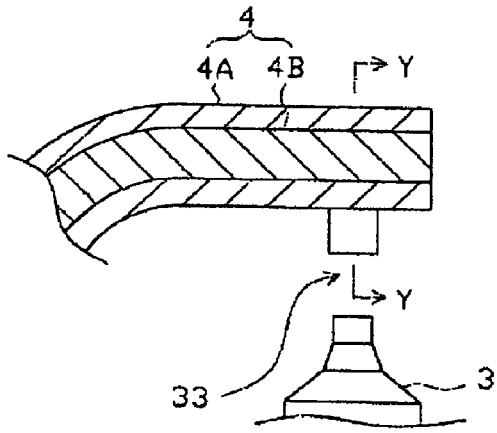

Further, the present invention may be composed by the following manner. As shown in FIG. 9A, provided that the ground electrode 4 and the center electrode 3 are projected from the front-end face side of the ground electrode 4 along the central axis C1 of the center electrode 3, tangent lines m1, m2 are drawn from two outer rims of the front-end of the center electrode 3, respectively so as not to intersect with each other with respect to a periphery line of the ground electrode 4, and the front-end portion of the ground electrode 4 are divided by, including a segment which connects both contact points PM1, PM2 of the tangent lines m1, m2, a planar face HM perpendicular to the front-end face of the ground electrode 4 into two portions: an inner side portion serving as a center electrode 3 side (lower side in the drawing); and an outer side portion serving as an opposed side to the center electrode 3 (upper side in the drawing), a spark plug may be composed in which, in the front-end portion of the ground electrode 4 [a front-end portion at the front-end side from the center of the spark discharge gap 33 (a right hand side portion of Y-Y line in FIG. 9B)], a volume Vo of an outer side inner layer 4BOS (a portion shown in a reticulate pattern in the drawing) with respect to the outer side portion is larger than a volume Vi of an inner side inner layer 4BIS (a portion shown in a dot pattern in the drawing) with respect to the inner side portion.

According to this composition, it is possible that the inner layer 4B formed in the front-end portion of the ground electrode 4 is made eccentric toward outer side, as well as disposed at a bit inner side. With this composition, the outer side inner layer 4BOS of the front-end portion of the ground electrode 4 actively conducts heat from a portion near the center of a combustion chamber to a metal shell 1. Further, since the front-end portion of the ground electrode 4 has the inner side inner layer 4BIS, it is possible to avoid releasing heat, which is received from the center of the combustion chamber by the outer layer 4A located in the outer side portion, through the inner side of the front-end portion of the ground electrode 4, thereby resulting in preventing any ignitability failure caused by drawing significant heat from an initial flame kernel formed between the spark discharge gap 33. Furthermore, when a noble metal tip joined to the ground electrode 4 is exposed in the spark discharge gap 33, it is possible to avoid an extreme heat cycle in use, thereby improving the durability of the tip.

(b) Although each embodiment mentioned above has embodied the ground electrode 4 having a circular-shape in the cross-section, the shape of the ground electrode is not necessarily limited to a circular-shape in the cross-section. Therefore, as shown in FIG. 8C, for example, the ground electrode 4 may assume a circular-shape in the cross-section with one section thereof lacking. In this case, as shown in the drawing, when the center electrode 3 side assumes a plane-shape, it is advantageous that the noble metal tip 32 is easily welded to the ground electrode 4. Of course, the ground electrode may assume either an ellipse shape, semicircular shape, or an oval shape in the cross-section. Furthermore, the curvature of the back face of the ground electrode may differ at the halfway point.

Figure 10:
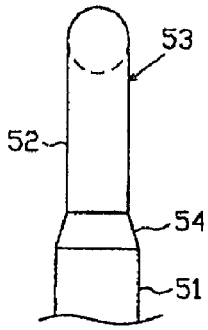
FIG. 10 shows a side shape of a ground electrode according to another embodiment.

(c) In the above-mentioned embodiments, although the ground electrode 4 assumes a rod-like shape with the same size and shape in the cross-section prior to being bent, it is not necessarily to be a rod-like shape. Thus, as shown in FIG. 10, for example, a ground electrode 53 comprised of a relatively large-diameter base portion 51 and a circular-shaped small-diameter portion 52 having a smaller diameter than that of the base portion 51 may be employed. As shown in the drawing, a tapered portion 54 may be formed between the base portion 51 and the small-diameter portion 52.

Figure 11:
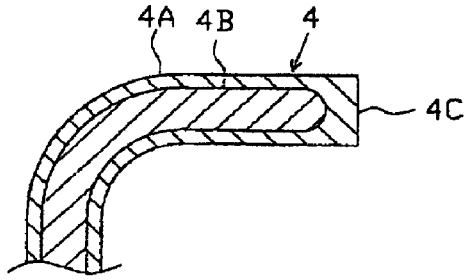
FIG. 11 is a partial cross-section showing a ground electrode according to another embodiment.

(d) In the above-mentioned embodiment, although the inner layer 4B reaches the front-end face of the ground electrode 4, for example, the front-end face may be covered with the outer layer 4A, as shown in FIG. 11.

(e) In the above-mentioned embodiment, although the inner layer 4B of the ground electrode 4 assumes a circular-shape in the cross-section, it is not necessarily to be a circular-shape. For example, the inner layer 4B may assume an ellipse or a rectangular shape in the cross-section.

(f) In the first embodiment, a pure copper is adopted as a material constituting the inner layer 4B, however, it may be a copper alloy having a higher thermal conductivity than that of the nickel alloy. However, the copper alloy necessarily contains over 50% by mass of copper.

The invention claimed is:

1. A spark plug for use in an internal-combustion engine, comprising:

a center electrode;

an insulator at least partially surrounding the center electrode;

a cylindrical metal shell at least partially surrounding the insulator;

a ground electrode so disposed that one end thereof is joined to a front-end face of the metal shell and the other end thereof faces the front-end face of the center electrode; and a spark discharge gap formed between the front-end face of the center electrode and a front-end portion of the ground electrode, wherein the ground electrode has a width between 1.3 mm and 1.7 mm at least in the front-end portion thereof located forward of a center of the spark discharge gap, wherein at least a portion of the ground electrode where sparks are discharged has an outer layer made of a nickel alloy selected from the group consisting of a nickel alloy having the following chemical composition:

a minimum of 72% nickel (plus cobalt);

14.0% to 17.0% chromium;

6.00% to 10.00% iron;

a maximum of 0.15% carbon;

a maximum of 1.0% manganese;

a maximum of 0.015% sulfur;

a maximum of 0.50% silicon; and a maximum of 0.50% copper or a nickel alloy having the following chemical composition:

58.0% to 63.0% nickel;

15.0% to 21.0% chromium;

1.0% to 1.7% aluminum;

a maximum of 0.10% carbon;

a maximum of 1.0% manganese;

a maximum of 0.015% sulfur;

a maximum of 0.50% silicon;

a maximum of 1.0% copper; and the remainder iron, and an inner layer made of pure copper or a copper alloy containing 98 wt% or more of copper having a better thermal conductivity than that of the outer layer, and wherein a ratio of a cross-sectional area of the inner layer to the entire cross-sectional area of the ground electrode is 10% or more to 28.4% or less, and said ratio is selected such that spring-back of said ground electrode during use of said spark plug is prevented.

2. A spark plug as defined in claim 1, wherein the ground electrode is dimensioned to have a reduced width toward a back face thereof, which back face is furthest from the center electrode, at least in a front-end portion of the ground electrode located forward of a center of the spark discharge gap.

3. A spark plug for use in an internal-combustion engine, comprising:

a center electrode;

an insulator at least partially surrounding the center electrode;

a cylindrical metal shell at least partially surrounding the insulator;

a ground electrode so disposed that one end thereof is joined to a front-end face of the metal shell and the other end thereof faces the front-end face of the center electrode; and a spark discharge gap formed between the front-end face of the center electrode and a front-end portion of the ground electrode, wherein the ground electrode has a width between 1.3 mm and 1.7 mm at least in the front-end portion thereof located forward of a center of the spark discharge gap and a convex-shaped curved face at a back face thereof located furthest from the center electrode side, wherein at least a portion of the ground electrode where sparks are discharged has an outer layer made of a nickel alloy selected from the group consisting of a nickel alloy having the following chemical composition:

a minimum of 72% nickel (plus cobalt);

14.0% to 17.0% chromium;

6.00% to 10.00% iron;

a maximum of 0.15% carbon;

a maximum of 1.0% manganese;

a maximum of 0.015% sulfur;

a maximum of 0.50% silicon; and a maximum of 0.50% copper or a nickel alloy having the following chemical composition:

58.0% to 63.0% nickel;

15.0% to 21.0% chromium;

1.0% to 1.7% aluminum;

a maximum of 0.10% carbon;

a maximum of 1.0% manganese;

a maximum of 0.015% sulfur;

a maximum of 0.50% silicon;

a maximum of 1.0% copper; and the remainder iron, and an inner layer made of pure copper or a copper alloy containing 98 wt% or more of copper having a better thermal conductivity than that of the outer layer, and wherein a ratio of a cross-sectional area of the inner layer to the entire cross-sectional area of the ground electrode is 10% or more to 28.4% or less, and said ratio is selected such that spring-back of said ground electrode during use of said spark plug is prevented.

4. A spark plug for use in an internal-combustion engine, comprising:

a center electrode;

an insulator at least partially surrounding the center electrode;

a cylindrical metal shell at least partially surrounding the insulator;

a ground electrode so disposed that one end thereof is joined to a front-end face of the metal shell and the other end thereof faces the front-end face of the center electrode; and a spark discharge gap formed between the front-end face of the center electrode and a front-end portion of the ground electrode, wherein the ground electrode has a width between 1.3 mm and 1.7 mm and wherein at least a portion of the ground electrode where sparks are discharged has an outer layer made of a nickel alloy selected from the group consisting of a nickel alloy having the following chemical composition:

a minimum of 72% nickel (plus cobalt);
14.0% to 17.0% chromium;
6.00% to 10.00% iron;
a maximum of 0.15% carbon;
a maximum of 1.0% manganese;
a maximum of 0.015% sulfur;
a maximum of 0.50% silicon; and
a maximum of 0.50% copper or a nickel alloy having the following chemical composition:

58.0% to 63.0% nickel;
15.0% to 21.0% chromium;
1.0% to 1.7% aluminum;
a maximum of 0.10% carbon;
a maximum of 1.0% manganese;
a maximum of 0.015% sulfur;
a maximum of 0.50% silicon;
a maximum of 1.0% copper; and
the remainder iron, and an inner layer made of pure copper or a copper alloy containing 98 wt% or more of copper having a better thermal conductivity than that of the outer layer, wherein a ratio of a cross-sectional area of the inner layer to the entire cross-sectional area of the ground electrode is 20% or more, and said ratio is selected such that spring-back of said ground electrode during use of said spark plug is prevented, and wherein the outer layer has a thickness of 0.2 mm or more.

5. A spark plug as defined in claim 4, wherein the ground electrode has a width of 2 mm or less and is dimensioned such that its width decreases toward a back face thereof, which back face is furthest from the center electrode side of the ground electrode, at least in the front-end portion of the ground electrode located forward of a center of the spark discharge gap.

6. A spark plug for use in an internal-combustion engine as claimed in any one of claims 1 to 5, wherein when a distance of the spark discharge gap is taken as G, a diameter of the front-end portion of the center electrode is taken as D, and a distance between a point nearest to the center electrode in the outer layer and a point nearest to the center electrode in the inner layer is taken as T0 when the ground electrode is projected from a front-end face side thereof along a central axis of the center electrode, then the distance T0 satisfies the expression $0.2\ \text{mm} \leqq T0 \leqq 0.5\ \text{mm}$ within a range of $\pm[(D/2)+G]$ from the central axis of the center electrode.

7. A spark plug for use in an internal-combustion engine as claimed in any one of claims 1 to 5, wherein when the ground electrode and the center electrode are projected from the front-end face side of the ground electrode along the central axis of the center electrode, tangent lines are drawn from two outer rims of the front-end of the center electrode, respectively, so as not to intersect with each other with respect to a periphery line of the ground electrode, and the periphery line is divided in two parts by contact points to define one part as a center electrode side and the other part as a back face side, then the inner layer is eccentric so that a thinnest portion of the outer layer is located at the back face side of the ground electrode.

8. A spark plug according to any one of claims 1 to 5, wherein when the ground electrode and the center electrode are projected from the front-end face side of the ground electrode along the central axis of the center electrode, tangent lines are drawn from two outer rims of the front-end of the center electrode, respectively, so as not to intersect with each other with respect to a periphery line of the ground electrode, and the front-end portion of the ground electrode are divided by, including a segment which connects both contact points of the tangent lines, a planar face perpendicular to the front-end face of the ground electrode into two portions: an inner side portion serving as a center electrode side; and an outer side portion serving as an opposed side to the center electrode, then, in the front-end portion of the ground electrode, a volume Vo of an outer side inner layer with respect to the outer side portion is larger than a volume Vi of an inner side inner layer with respect to the inner side portion.

* * * * *